US005667445A

United States Patent [19]

Lochtefeld

[11] Patent Number: 5,667,445

[45] **Date of Patent: *Sep. 16, 1997**

[54] JET RIVER RAPIDS WATER ATTRACTION

[75] Inventor: Thomas J. Lochtefeld, La Jolla, Calif.

[73] Assignee: Light Wave Ltd., Reno, Nev.

[ * ] Notice: The term of this patent shall not extend beyond the expiration date of Pat. No. 5,421,782.

[21] Appl. No.: 463,264

[22] Filed: Jun. 5, 1995

Related U.S. Application Data

[63] Continuation-in-part of Ser. No. 65,467, May 20, 1993, Pat. No. 5,421,782, which is a continuation of Ser. No. 836,100, Feb. 14, 1992, abandoned, which is a continuation-in-part of Ser. No. 568,278, Aug. 15, 1990, abandoned, said Ser. No. 463,264, Jun. 5, 1995, is a continuation-in-part of Ser. No. 398,158, Mar. 3, 1995, Pat. No. 5,628,584, which is a continuation of Ser. No. 866,073, Apr. 1, 1992, Pat. No. 5,401,117, which is a continuation of Ser. No. 722,980, Jun. 28, 1991, abandoned, said Ser. No. 463,264, Jun. 5, 1995, is a continuation-in-part of Ser. No. 393,071, Feb. 23, 1995, Pat. No. 5,564,859, which is a continuation of Ser. No. 74,300, Jun. 9, 1993, Pat. No. 5,393,170, which is a continuation of Ser. No. 577,741, Sep. 4, 1990, Pat. No. 5,236,280, which is a continuation-in-part of Ser. No. 286, 964, Dec. 19, 1988, Pat. No. 4,954,014.

[51] Int. Cl.[6] ..... A63G 21/18

[52] U.S. Cl. ..... 472/117

[58] Field of Search ..... 472/116, 117, 472/128; 104/69, 70

[56] References Cited

U.S. PATENT DOCUMENTS

| | | |
|---|---|---|
| 419,860 | 1/1890 | Libbey . |
| 490,484 | 1/1893 | MacKaye . |
| 799,708 | 9/1905 | Boyce . |
| 1,648,196 | 11/1927 | Rohmer . |
| 1,655,498 | 1/1928 | Fisch . |
| 1,701,842 | 2/1929 | Fisch . |
| 1,871,215 | 8/1932 | Keller et al. . |

(List continued on next page.)

FOREIGN PATENT DOCUMENTS

| | | |
|---|---|---|
| 1204629 | 10/1968 | Canada . |
| 96216 | 12/1983 | European Pat. Off. . |
| 1019527 | 10/1952 | France . |
| 1300144 | 6/1962 | France . |
| 1539959 | 8/1968 | France . |
| 159793 | 8/1903 | Germany . |

(List continued on next page.)

OTHER PUBLICATIONS

Fauvelle/Blocquel, *Brevet D'Invention*, Sep. 19 1933.

Hornung/Killen, *A Stationary Oblique Breaking Wave for Laboratory Testing of Surfboards*, Journal of Fluid Mechanics, May 7, 1976, vol. 78, Part 3, pp. 459–484.

Killen, *Model Studies for a Wave Riding Facility*, 7th Australasian Hydraulics and Fluid Mechanics Conference, Brisbane, Aug. 1980.

Killen/Stalker, *A Facility for Wave Riding Research*, 8th Australasian Fluid Mechanics Conference, University of Newcastle, N.S.W., Dec. 2, 1983.

Dunn, *Splash Magazine*, "Wave Action Rivers", Jan. 1992, vol. XI, No. 1.

*Primary Examiner*—Kien T. Nguyen

*Attorney, Agent, or Firm*—J. John Shimazaki

[57] ABSTRACT

The present invention relates to a water ride in the form of a river loop having a channel, wherein a portion of the channel is shallow and has a supercritical sheet flow of water thereon, and a portion of the flow in the channel is relatively deep and has a subcritical flow thereon, wherein a rider can float on a floating device, such as an inner tube, and can be carried from the deep portion and onto the shallow portion, and then back into the deep portion. The rider can experience the thrill of being accelerated through the channel by the sheet flow, and because the water ride is in the form of a loop, the rider can repeatedly ride the sheet flow of water without having to exit. A hydraulic jump is preferably created, as the supercritical sheet flow meets the subcritical flow, through which riders travel for a thrilling ride experience.

58 Claims, 5 Drawing Sheets

U.S. PATENT DOCUMENTS

| | | |
|---|---|---|
| 1,884,075 | 10/1932 | Meyers . |
| 1,926,780 | 9/1933 | Lippincott . |
| 2,815,951 | 12/1957 | Baldanza . |
| 3,005,207 | 10/1961 | Matrai . |
| 3,038,760 | 6/1962 | Crooke . |
| 3,085,404 | 4/1963 | Smith . |
| 3,404,635 | 10/1968 | Bacon et al. . |
| 3,473,334 | 10/1969 | Dexter . |
| 3,477,233 | 11/1969 | Andersen . |
| 3,478,444 | 11/1969 | Presnell et al. . |
| 3,557,559 | 1/1971 | Barr . |
| 3,562,823 | 2/1971 | Koster . |
| 3,598,402 | 8/1971 | Frenzl . |
| 3,611,727 | 10/1971 | Blandford . |
| 3,789,612 | 2/1974 | Richard et al. . |
| 3,802,697 | 4/1974 | Le Mehaute . |
| 3,830,161 | 8/1974 | Bacon . |
| 3,851,476 | 12/1974 | Edwards . |
| 3,853,067 | 12/1974 | Bacon . |
| 3,913,332 | 10/1975 | Forsman . |
| 3,923,301 | 12/1975 | Myers . |
| 3,930,450 | 1/1976 | Symons . |
| 3,981,612 | 9/1976 | Bunger et al. . |
| 4,062,192 | 12/1977 | Biewer . |
| 4,149,710 | 4/1979 | Rouchard . |
| 4,194,733 | 3/1980 | Whitehouse, Jr. . |
| 4,196,900 | 4/1980 | Becker et al. . |
| 4,198,043 | 4/1980 | Timbes et al. . |
| 4,201,496 | 5/1980 | Andersen . |
| 4,276,664 | 7/1981 | Baker . |
| 4,278,247 | 7/1981 | Joppe et al. . |
| 4,339,122 | 7/1982 | Croul . |
| 4,392,434 | 7/1983 | Durwald et al. . |
| 4,429,867 | 2/1984 | Barber . |
| 4,522,535 | 6/1985 | Bastenhof . |
| 4,539,719 | 9/1985 | Schuster et al. . |
| 4,564,190 | 1/1986 | Frenzl . |
| 4,662,781 | 5/1987 | Tinkler . |
| 4,778,430 | 10/1988 | Goldfarb et al. . |
| 4,790,685 | 12/1988 | Scott et al. . |
| 4,792,260 | 12/1988 | Sauerbier . |
| 4,805,896 | 2/1989 | Moody . |
| 4,805,897 | 2/1989 | Dubeta . |
| 4,836,521 | 6/1989 | Barber . |
| 4,905,987 | 3/1990 | Frenzi . |
| 4,954,014 | 9/1990 | Sauerbier et al. . |

FOREIGN PATENT DOCUMENTS

| | | |
|---|---|---|
| 373684 | 7/1932 | Germany . |
| 2222594 | 5/1972 | Germany . |
| 2714223 | 10/1978 | Germany . |
| 96216 | 2/1983 | Germany . |
| 52-41392 | 3/1977 | Japan . |
| 176562 | 4/1935 | Switzerland . |
| 212138 | 4/1968 | U.S.S.R. . |
| 953075 | 8/1982 | U.S.S.R. . |
| 375684 | 6/1932 | United Kingdom . |
| 1090262 | 2/1965 | United Kingdom . |
| 1118083 | 3/1966 | United Kingdom . |
| 1159269 | 11/1967 | United Kingdom . |
| 1204629 | 9/1970 | United Kingdom . |
| WO8304375 | 12/1983 | WIPO . |
| WP9006790 | 6/1990 | WIPO . |

JET RIVER RAPIDS WATER ATTRACTION

RELATED APPLICATIONS

This application is a continuation-in-part of U.S. Ser. No. 08/065,467, filed May 20, 1993 now U.S. Pat. No. 5,421,782, which is a continuation of U.S. Ser. No. 07/836,100, filed Feb. 14, 1992, now abandoned, which is a continuation-in-part of U.S. Ser. No. 07/568,278, filed Aug. 15, 1990, now abandoned.

This application is a continuation-in-part of U.S. Ser. No. 08/398,158, filed Mar. 3, 1995 now U.S. Pat. No. 5,628,584, which is a continuation of U.S. Ser. No. 07/866,073, filed Apr. 1, 1992 now U.S. Pat. No. 5,401,117, which is a continuation of U.S. Ser. No. 07/722,980, filed Jun. 28, 1991, now abandoned.

This application is a continuation-in-part of U.S. Ser. No. 08/393,071, filed Feb. 23, 1995 now U.S. Pat. No. 5,564,859, which is a continuation of U.S. Ser. No. 08/074,300, filed Jun. 9, 1993 now U.S. Pat. No. 5,393,170, which is a continuation of U.S. Ser. No. 07/577,741, filed Sep. 4, 1990, which issued as U.S. Pat. No. 5,236,280, on Aug. 17, 1993, which is a continuation in part of U.S. Ser. No. 07,286,964, filed Dec. 19, 1988, which issued as U.S. Pat. No. 4,954,014, on Sep. 4, 1990.

FIELD OF THE INVENTION

The present invention relates in general to water rides, and in particular, to a jet river rapids attraction wherein a channel containing water is adapted to provide a jet flow of water upon which riders can ride.

BACKGROUND OF THE INVENTION

In recent years, there has been a phenomenal growth in the number and size of amusement parks consisting of water rides, i.e., the water theme park. Water rides have attempted to simulate existing natural conditions, and have created new and exciting unnatural conditions. For instance, various types of water rides, including water slides, wave pools, activity pools, flume boat rides, river rides and sheet wave generators, have become popular. In fact, one or more of these water rides can be found in nearly every amusement or theme park in the country.

Various reasons contribute to the popularity of these water rides. Some rides, like water slides, provide riders with high speed excitement. Other rides, like wave pools, provide extended user participation time in water, which is particularly enjoyable during hot weather. Other rides, like sheet wave generators, simulate existing conditions, so that riders can perform actual water sports activities, such as surfing.

Generally, the high speed water rides, while exciting, are relatively short in duration. For example, many are gravity induced, such as water slides, and therefore, end as soon as gravity moves the participant from a high point to a low point. Another disadvantage of many high speed water rides is low throughput. Many gravity induced water rides, for instance, permit only one or two participants to ride at one time.

Some water rides, however, such as the wave pool, or a variation of the wave pool, provides extended user participation time, and increased throughput. Nevertheless, wave pools do not provide high speed excitement, which many water ride enthusiasts prefer. They are also large and expensive to manufacture, and inherently carry a significant risk to participants of drowning on account of the depth of the water. Indeed, the potential liability associated with the risk of drowning is often a deterrent against operating such facilities. The cost of supplying a sufficient number of lifeguards to properly supervise the entire facility can also be high.

It is desirable, therefore, to create an integrated water ride attraction that provides high speed excitement, extended participation time, and high throughput, but also is relatively safe, and requires minimal supervision by lifeguards. It is also desirable to provide a water ride that not only has the above advantages, but is also relatively inexpensive to manufacture and operate.

SUMMARY OF THE INVENTION

The present invention represents an improvement over previous water rides in that the present invention comprises an endless river loop having a unidirectional flowing body of water therein, wherein at least a portion of the loop is shallow and has thereon a supercritical flow of water. In the preferred embodiment, another portion of the loop is relatively deep and has a subcritical flow of water thereon, wherein a rider floating in the loop can ride on both the shallow and deep portions of the loop without having to exit the river loop. In an alternate embodiment, the entire channel is shallow, and has a supercritical sheet flow of water injected unidirectionally onto the channel floor, creating hydraulic pressure differentials, which cause some areas on the channel to have a shallow flow thereon, and other areas to have a relatively deep flow thereon.

An advantage of the present invention is that riders can ride the unidirectional flowing body of water for an extended period of time, unlike some high speed rides. Riders can also enter directly onto the shallow portion and repeatedly experience high speed water effects as often as the rider desires. In addition, because a number of riders can ride on the water ride at a single time, unlike many high speed rides, the present invention has relatively high throughput.

The present invention comprises a channel, wherein the channel has at least one shallow portion, and, in the preferred embodiment, at least one deep portion. In the preferred embodiment, both portions of the channel are preferably shallow enough that the risk of drowning is reduced. The momentum of the supercritical sheet flow helps drive the unidirectional flowing body of water around the river loop.

At least one jet nozzle propels water onto the shallow portion in the direction of flow at supercritical speeds, creating a sheet flow of water, upon which riders floating in the channel can ride. In the preferred embodiment, a cross-stream hydraulic jump is created as the sheet flow of water on the shallow channel portion meets the slower moving subcritical flow of water in the deep channel portion.

The shallow channel portion is preferably substantially level and flat, although variations in topography, which create special water effects, as will be discussed, are within the contemplation of the present invention. While the preferred embodiment of the present invention has at least one shallow channel portion, followed by at least one deep channel portion, the present invention can also have multiple shallow and deep channel portions, with multiple jet nozzles, intermittently spaced throughout the water ride, to provide a number of areas having supercritical flows thereon.

The riders that ride the present invention typically float on the water in inner tubes, or other floatation devices, that move in the direction of flow. By floating on the water, the inner tubes, or other devices, can easily be carried and accelerated through the shallow channel portion by the sheet flow. While the sheet flow on the shallow channel portion is preferably thin, the sheet flow is nevertheless deep enough to permit the inner tubes, or other devices, to float on the supercritical flow, rather than slide along the bottom of the channel, although some sliding will not substantially inhibit the speed at which the rider travels through the shallow channel.

The jet nozzles are preferably positioned along a line normal to the direction of flow, and, in the preferred embodiment, located at or near the upstream end of the shallow channel portion. Each of the nozzles are aligned so that they propel water in a direction substantially parallel to and in the direction of flow. The nozzles are preferably horizontally oriented, and positioned below the surface of the water, although they can be tilted slightly so that the jet flow is directed slightly upward or downward. The nozzles can be placed across the entire width of the channel to form a sheet flow that extends across the channel, or, in other embodiments, across only a portion of its width.

Water is injected through the jet nozzles at a velocity sufficient to create a supercritical flow of water on the shallow channel portion. The water that is propelled onto the shallow channel portion is drawn by a pump from a location slightly upstream from the jet nozzles. For instance, in the preferred embodiment, the pump draws water from the deep portion, and, under pressure, propels water through the nozzles, and onto the shallow channel portion at supercritical speed. A grate is provided at the point where water is drawn into the pump to prevent riders from accidentally being pulled into the pump area. The grate is positioned within the deep channel portion, adjacent to the shallow channel portion, and below the surface level of the water, so that riders can easily maneuver over the grate area and directly onto the shallow channel portion from the deep channel portion.

Not all of the water in the channel is drawn into the pump. Some water from the deep channel portion, for instance, may flow directly over the grate and jet nozzles, and onto the shallow channel portion, so that riders can float over the grate area without interruption. The water that flows over the grate is eventually accelerated by the momentum of the supercritical flow to form a uniform sheet flow of water thereon.

The jet nozzles are relatively narrow in height and long in width so that as the pump pushes water through the nozzle housing, water is extruded in the form of a slab, and accelerated, through the nozzles at a substantially high velocity. The velocity at which the water flows through the nozzles can be adjusted by adjusting the pressure generated by the pump, and/or the size of the openings in the nozzles.

In the preferred embodiment, at the junction of the shallow and deep channel portions, the supercritical sheet flow of water meets the slow moving subcritical flow of water in the deep channel portion, and creates a hydraulic jump, which forms various water formations, such as bubbles, boils and flow shears. While the energy from the supercritical sheet flow cannot cause the water in the deep channel portion to move at the same speed as the supercritical flow, it does cause a transfer of momentum which helps drive the water in the deep channel portion in the direction of flow. The speed and momentum of the flow is also preferably great enough to overcome the potential drag caused by a large number of riders riding on the channel at one time.

During use, a rider floating in the endless loop can be carried from the deep channel portion, propelled by the supercritical sheet flow of water in the direction of flow onto the shallow portion, and then carried back into the deep channel portion, after passing through a hydraulic jump, formed at the junction of the shallow and deep channel portions. Because the present invention is in the form of a river loop, riders floating in the channel can ride the shallow and deep channel portions, respectively, over and over, in the direction of flow, without having to exit the water ride. An entrance and exit area is provided along the deep channel portion so that riders can safely enter and exit the ride when desired.

In an alternate embodiment, as discussed above, the entire channel is substantially shallow. In this embodiment, the floor of the channel is substantially uniform in elevation, although it can also have topographical changes thereon. A supercritical sheet flow of water is injected by jet nozzles onto the shallow channel floor, as in the preferred embodiment, to create a shallow sheet flow of water. In this alternate embodiment, the grate is positioned at the same level as the floor, and the pump is located underneath.

Because the entire floor is shallow and substantially uniform in elevation, the sheet flow continues to travel around the loop at supercritical speeds, until, as a result of friction and hydraulic pressure differentials, the speed at which it flows eventually becomes critical, and then subcritical, causing a hydraulic jump to occur. The depth of the water in the channel, despite the floor being substantially uniform in elevation, can vary depending on the hydraulic pressure differential created by water being injected unidirectionally. That is, in a closed system, the supercritical flow forms a shallow flow area immediately downstream from the jet nozzles, but because the water eventually slows down and becomes thicker as it flows downstream, a substantially deeper flow area, having a higher surface elevation, is also formed.

In another alternate embodiment, the shallow channel portion and/or the supercritical flow extends along only one side of the channel, so that part of the channel has a supercritical flow thereon, and part of the channel does not. In this embodiment, the line of nozzles, the grate, the sump area and the pump, are positioned along only one side of the channel. Riders can choose between riding the supercritical flow on one half of the channel, or the slower moving flow on the other half.

In any of the embodiments, to create additional water effects and formations, the bottom surface of the shallow channel portion can have topographical changes thereon, which can cause water to flow in different patterns. For instance, various bumps, or inclines and declines, can be added to the bottom surface or sides of the shallow channel portion, to cause water to flow over and/or around the contours thereof, or, upon encountering a turn, the bottom surface can be embanked. In the preferred embodiment, the deep channel portion can also be widened and/or narrowed, or provided with topographical changes, so as to substantially change the flow of water therethrough, or create special rapid effects.

Additional jet nozzles can also be added on the shallow channel portion to create different flow patterns. For instance, additional nozzles can be provided that inject water tangentially into the channel so that, upon encountering the tangential flow, a particular rider's direction of travel can be altered at that point. Nozzles that continually change the direction of flow can also be provided intermittently along the floor of the shallow channel portion so that a rider travelling through the shallow channel portion will not know until the particular nozzles are actually encountered which direction he/she will travel. This will provide the present invention with a bumper boat effect, causing riders to change direction and collide with each other in the channel.

An island can be formed within the center of the river loop, which can be covered with sand, and/or vegetation, with a bridge extending across the channel, so that participants can cross over the channel, and watch, or otherwise enter and exit the channel from the island. Stairs can be provided along an inside part of a deep channel portion to provide easy entrance and exit.

The present invention is now shown and described in more detail in the following drawings and detailed description.

DETAILED DESCRIPTION OF THE INVENTION

Figure 1:
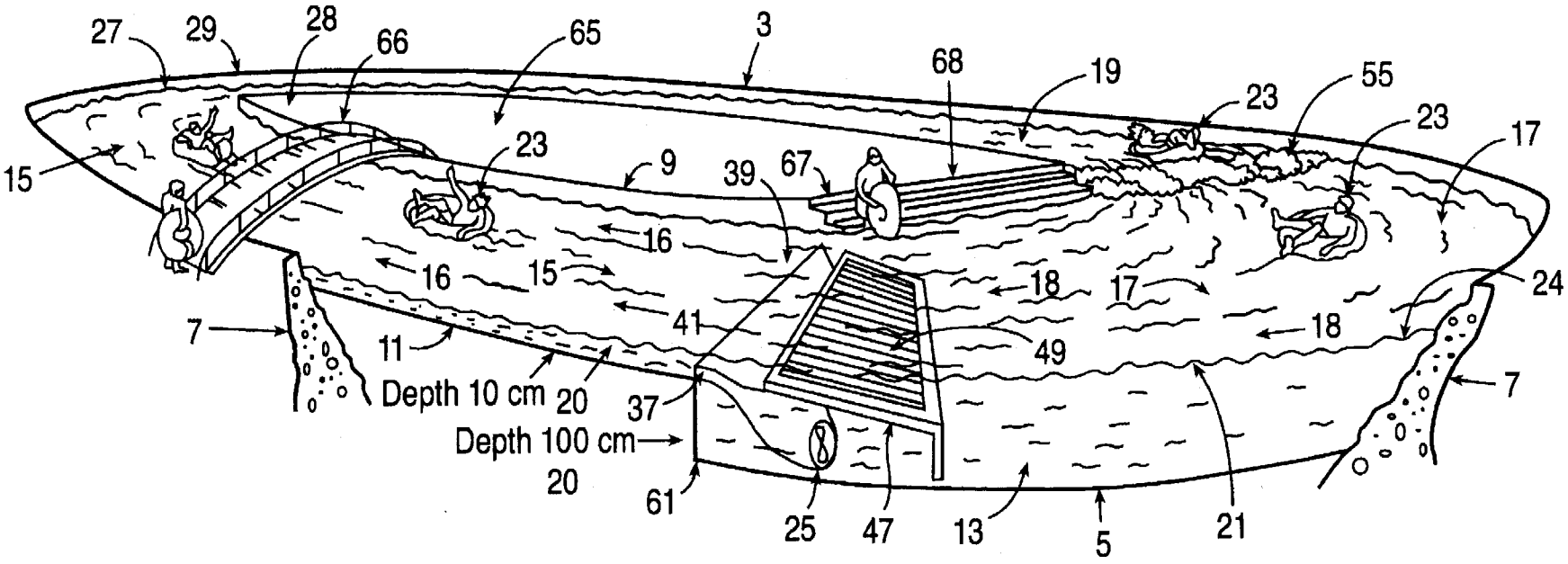
FIG. 1 is a perspective view of the present invention.

As shown in FIG. 1, the present invention is a water ride in the form of a river loop 1 comprising a channel or trough 3 generally having a floor 5 and two sidewalls 7, 9. At least a portion of the channel 3 is formed with a shallow floor 11, and, in the preferred embodiment, at least a portion of the channel is formed with a deep floor 13. The shallow floor 11 extends across a shallow channel portion 15, and the deep floor 13 extends across a deep channel portion 17. In the preferred embodiment of the river loop 1, there is at least one shallow channel portion 15 and at least one deep channel portion 17, which are adjacent to one another, such that in the loop, each end of a shallow portion is adjacent a deep portion, and, each end of a deep portion is adjacent a shallow portion.

Within the channel 3 is preferably a unidirectional flowing body of water 19, the surface level 21 of which is generally substantially equal in elevation, but for the effects caused by the movement of water therein. Water 18 in the deep channel portion 17 is preferably between 1 to 4 feet in depth, with a preferred depth of about 3 feet. Water 16 on the shallow channel portion, which is a supercritical sheet flow of water, is preferably between 3 to 6 inches deep, with a preferred depth of about 4 inches. The maximum depth of the water in the deep channel portion 17 is provided as a safety feature to minimize the risk of drowning and facilitate the ease of inner tube ingress and eggress. A depth that is any greater than 3 feet substantially increases the risk of drowning and makes inner tube entry difficult. The depth of water in the shallow channel portion is provided to ensure that floating devices, such as inner tubes 70, can float freely on the body of water without experiencing drag along the bottom floor 11 of the channel. Any dimension given in this discussion is merely illustrative and should not be construed as being a limitation on the present invention.

Figure 2:
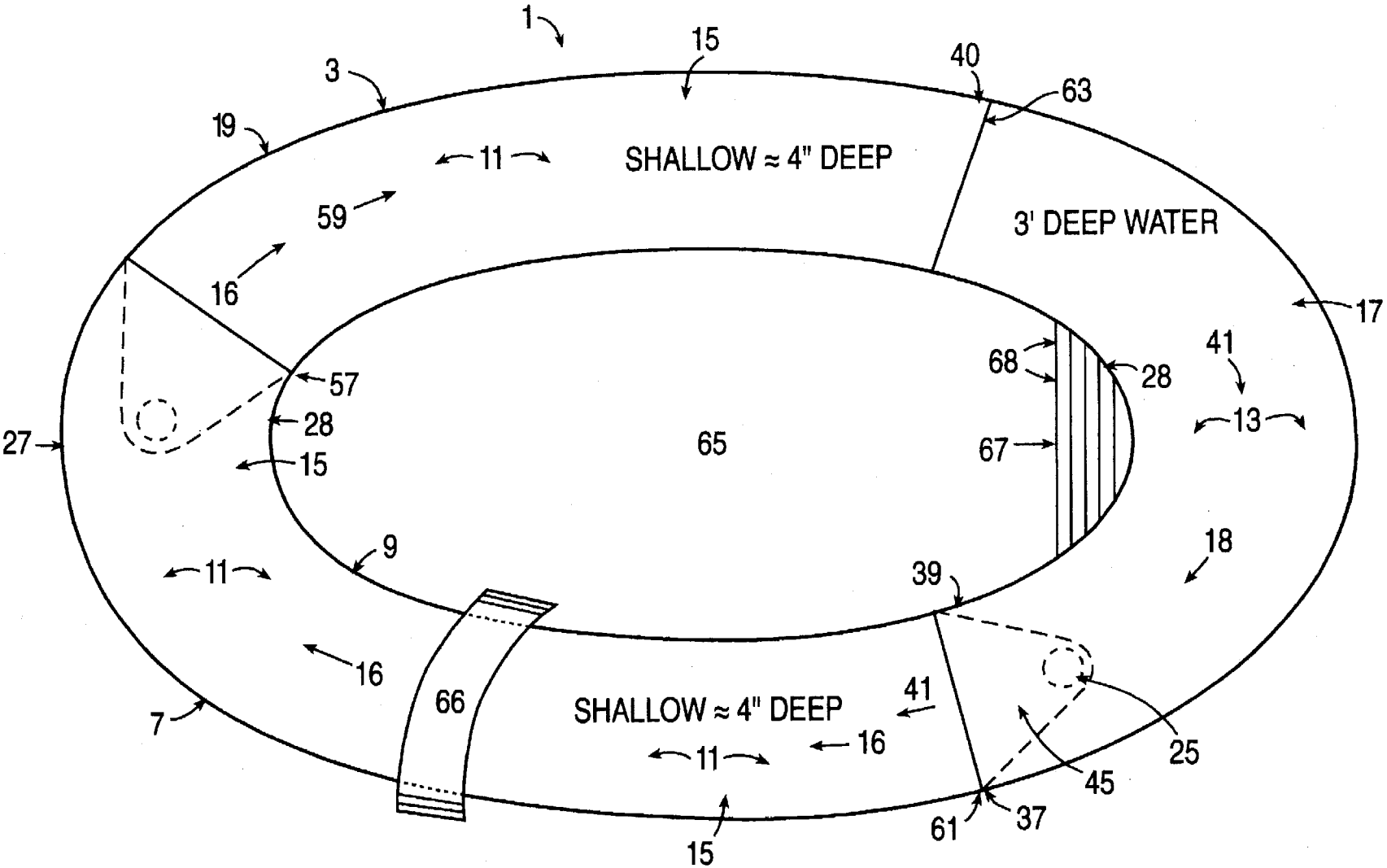
FIG. 2 is a top view of the present invention.

The channel 3 is generally about 10 to 30 feet in width, depending on the overall desired size of the water ride, with a preferred width of about 15 feet. As shown in FIG. 2, in the preferred embodiment, the width is relatively constant throughout the length of the water ride. However, the water ride can be made to have varying widths as will be described. On the one hand, the larger the water ride, the wider the channel, and therefore, the greater the throughput. On the other hand, the larger the water ride, the more costly to build and operate. Preferably, the width of the channel should be large enough to accommodate a number of riders 23 riding side by side in the channel 3.

When the width of the deep channel portion 17 is varied, the width should be calculated as a function of depth, or cross-sectional area, such that the proper flow characteristics and velocities through the deep channel portion are achieved. A narrowing of the deep channel portion, and a reduction in the cross-sectional area, for instance, can cause the water flow to back up behind the narrow portion. On the other hand, a reduction in cross-sectional area can cause the water to accelerate through the narrow portion, as a function of mass conservation.

Additional variations to the depth and width of the deep channel portion 17 should also take into consideration the friction caused by the overall surface area of contact between the water and channel 3. For example, a wide shallow channel (e.g., 1×16), having the same cross-sectional area as a narrow deep channel (e.g., 4×4), may have a greater friction component, as the wider channel has a greater surface area exposed to water (e.g., 18 compared to 12). Nevertheless, the flow of water 18 in the deep channel portion is preferably subcritical and relatively slow moving so that the friction losses of the deep channel portion will not greatly affect the flow of water therein. On the other hand, if the speed at which the water flows through the deep channel portion 17 is important, the cross-sectional characteristics are taken into consideration.

The sheet flow of water 16 on the shallow channel portion 15 is accelerated mechanically by a pump 25, or other similar means, as will be discussed, and therefore, the width and depth of that portion will not substantially affect the flow of water thereon, provided that the cross-sectional area of the shallow channel portion is otherwise sufficient to permit free flow. On the one hand, a wide shallow channel, which is preferred, may create greater friction forces between the channel and water, so that over a distance the speed of the supercritical flow will tend to be reduced. On the other hand, a wide channel will permit the water to flow freely and consistently over the entire width of the channel floor, and increase throughput.

The channel has side walls 7, 9 that extend around the outside and inside of the channel. The side walls 7, 9 are constructed so that they extend upward from the floor 5 of the channel to about 12 to 18 inches or more above the normal level of the water 21 in both the shallow and deep portions, particularly around the outside of a turn 27 in the loop. While the level of the water in the channel 3 fluctuates, depending on how fast water is permitted to flow within the channel, the top edge 29 of the side walls preferably extends about an average of at least 12 inches above the top of the water level 21 during operation. This is so that there is adequate room for water within the channel to flow without undesireably escaping over the edge 29 of the side walls, and to safely maintain the riders 23 within the channel, even during high speed flows.

The side walls 7, 9 preferably extend upward, as shown in FIG. 1, to form a slope, or embankment, along the edge of the channel. The side walls 7, 9 also help to maintain the water flowing within the channel, and keep the riders within the channel.

The channel 3 can also have a right angle trough shape, or u-shape, cross-sectional configuration, if desired. The same considerations for ensuring proper flow characteristics and velocities should be considered in these unique configurations.

The channel 3 can be made of concrete or any strong material, such as fibre-glass, or steel, and can be coated with a water-proof material, such as rubber or plastic. The surface of the channel is also preferably covered with a soft, impact-absorbant material, such as foam, particularly on the shallow channel portion 15, so that the risk of injury is reduced. The channel can be built into the ground so that the surface level 21 of the water is at or near the elevation of the adjacent ground.

The length of the entire loop 1, taken in the center of the channel, can be between 50 feet to 5,000 feet, depending on the overall size of the water ride, but is preferably about 300 to 1000 feet in length. The length of any particular shallow channel portion 15 is preferably about 50 to 300 feet, although it can extend around a turn 27 considerably longer, as shown in FIG. 2, provided that the supercritical flow has enough energy to continue around the turn. The length of the shallow channel portion is a function of how far the supercritical sheet flow of water will travel before friction reduces its speed and causes it to become a critical, or even subcritical, flow.

The floor 13 of the deep channel portion 17 is preferably level and flat, although various changes in topography can be provided, causing special water effects, such as stationary waves and hydraulic jumps. These changes are achieved by fastening rubber structures, like artificial boulders or bumps (not shown), to the channel so that they protrude into the channel. The overall topography of the deep channel floor 13 can also be altered to form variations in the depth. Of course, any topographic changes will affect the overall flow of water through the channel, and therefore, flow characteristics must be taken into consideration when altering the topography of the channel 3.

Figure 3:
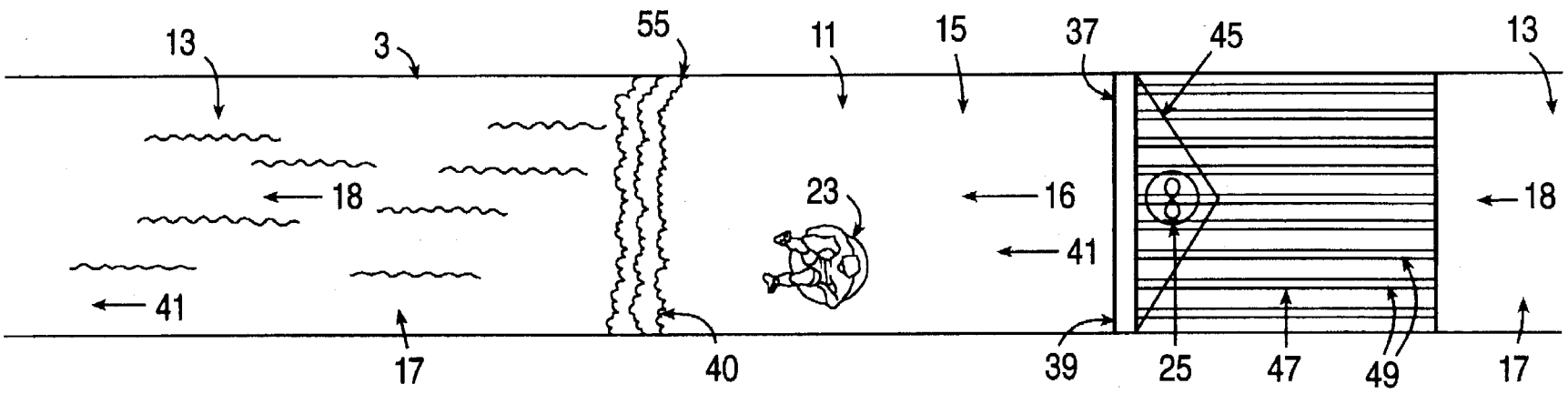
FIG. 3 is a top view of a straight embodiment of the shallow channel portion.

The floor 11 of the shallow channel portion 15 is also preferably level and flat, although it can be embanked, such as along a curved portion 27 of the loop. The shallow channel portion can also be made straight, without an embankment, as shown in FIG. 3. In general, the shallow channel portion 15 is adapted to receive a sheet flow of water 16 that is propelled at supercritical speeds. Topographical changes can also be provided on the shallow floor 11, although due to the speed at which the water, and therefore, the riders 23, will be travelling thereon, even the slightest change in topography can cause a significant change in the flow of water. For instance, jumps can be created on the shallow floor 11 by raising the shallow floor 11 slightly, so that riders can actually become slightly airborne when travelling on the shallow channel portion with sufficient velocity.

In an embodiment where the curve 27 in the shallow channel portion of the loop is relatively tight (not shown), the floor 11 of the shallow channel portion 15 can be embanked and slightly narrowed at that point, so that the sheet flow of water 16 converges on itself somewhat, which permits the sheet flow of water to accelerate around the turn, as a function of mass conservation. It also helps water flowing on the outside of the turn 27, which has a greater distance to travel, keep up with water flowing on the inside of the turn 28. Of course, the converging sheet flow of water will create its own water effects which will result in riders 23 converging together, which can enhance the bumper boat effect of the water ride.

Figure 4:
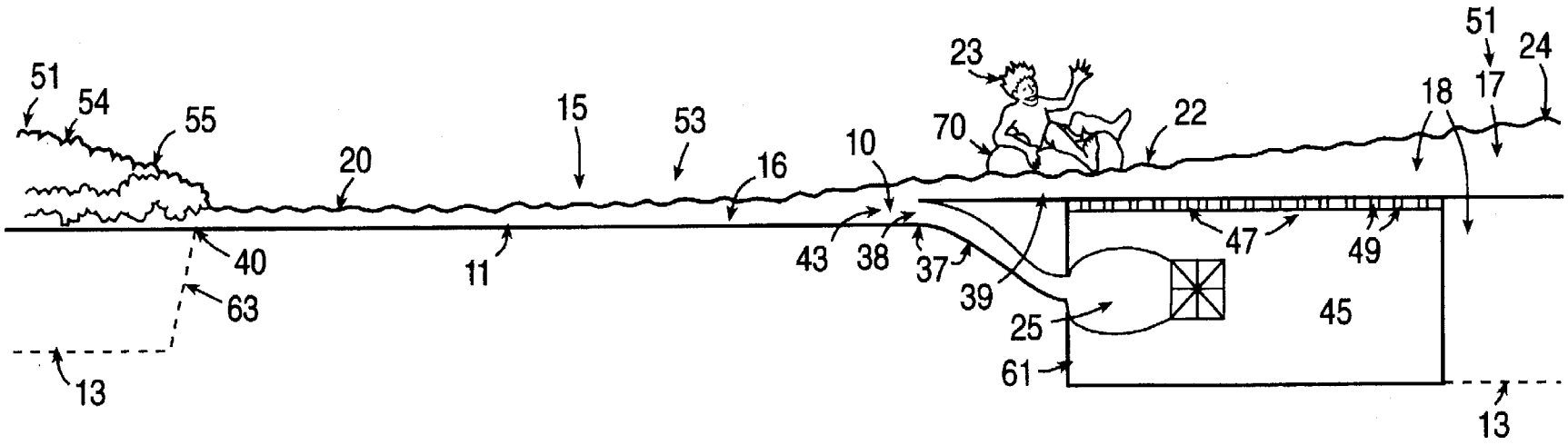
FIG. 4 is a side view of the shallow channel portion of the present invention.

As shown in FIG. 3, there is at least one jet nozzle 37 positioned, at least in the preferred embodiment, along the upstream end 39 of the shallow channel portion 15. Each of the jet nozzles 37 are preferably pointed in a direction 41 parallel to and in the direction of flow. The jet nozzles 37 are positioned on the shallow floor 11 so that they are relatively out of view from above and are below the surface level of water 22 flowing over the jet nozzles, as shown in FIG. 4. Nevertheless, the jet nozzles are close enough to the surface level 22 so that the water being injected from the jet nozzles form a thin sheet flow of water 16 of about 3 to 6 inches in depth, as discussed above.

The jet nozzles 37 are preferably substantially horizontally oriented so that they inject water substantially horizontally onto the shallow floor 11. The shallow floor 11, accordingly, is cut away 43 slightly downstream, as shown in FIG. 4, to permit water flowing through the jet nozzles to flow directly onto the shallow channel floor 11. The jet nozzles can also be slightly tilted upwardly, yet turned to horizontal, so that the nozzles can be positioned substantially below the shallow floor 11.

The jet nozzle openings 38 are relatively narrow so that water is extruded, and accelerated, under pressure, as water is pumped therethrough. The size of the nozzle openings 38 can be adjusted, or the pressure otherwise adjusted, to adjust the velocity of flow. Additional description of supercritical sheet flows and related water ride concepts can be found in related U.S. Pat. Nos. 4,792,260; 4,954,014; 5,171,101; 5,236,280; 5,271,692; and 5,213,547, and related applications U.S. Ser. Nos. 07/722,980; and 07/836,100; the relevant portions of which are incorporated herein by reference.

Immediately upstream of the jet nozzles 37 is a sump area 45 for drawing water from the deep channel portion 17. As shown in FIG. 4, a pump 25, or series of pumps, is provided to draw water from the deep channel portion 17, and to propel water, under pressure, through the jet nozzles 37, onto the shallow channel portion 15, to form a supercritical sheet flow of water 16 thereon. While it is not necessary that the sump area 45 be in close proximity to the jet nozzles 37, it is preferred, so that there is minimal line loss and little hydraulic disturbance between the point where water is drawn from the deep channel portion, and the point where water is injected back onto shallow channel portion.

A grate 47 is provided over the sump area 45 which prevents riders 23 from accidentally being drawn into the sump area, but permits water to be drawn therethrough. Although the grate 47 is below the surface level of the water at that point 22, and would not otherwise interfere with the passage of the riders, water being drawn into the sump area 45 causes water to be drawn down, causing the surface level at that point to drop. The grate 47 is, therefore, preferably sufficiently below the surface level of the water 22 so that water flows over the grate and the grate itself is not exposed as water is being drawn. In the preferred embodiment, the grate is also preferably angled, as shown in FIG. 1, so that riders floating in the deep channel portion can easily flow over the grate and onto the shallow channel portion. The grate bars 49 are preferably aligned in the direction of flow so that riders do not accidentally catch one of the bars as he/she passes thereby.

While much of the water flowing onto the shallow channel portion 15 is injected from the jet nozzles 37, there is also water that naturally flows from the deep channel portion, over the grate, and onto the shallow floor, as shown in FIG. 4. That is, not all of the water flowing through the deep channel portion 17 is drawn into the sump 45. Water also flows over the grate 47, and directly onto the shallow channel portion, so that a rider floating in the deep channel portion can float without interruption from the deep channel portion 17 onto the shallow channel portion 15, as shown in FIG. 4. A rider's movement from the deep channel portion 17 to the shallow channel portion 15 is a result of two hydraulic principles, which are discussed as follows:

First, a hydraulic pressure differential is created between the shallow channel portion and the deep channel portion, by water being drawn into the sump 45, which causes the surface level of the water 22 immediately upstream of the shallow channel portion to be less than the surface level 24 of the water 18 in the deep channel portion, as shown in FIG. 4. Water seeks its own level from a high pressure area 51 to a low pressure area 53, and naturally causes water to flow from the deep channel portion 17 to the shallow channel portion 15.

Second, water flowing over the grate 47 and over the jet nozzles 37 is entrained, by water being injected through jet nozzles 37, with the supercritical flow 16, which, through momentum transfer, forms a mixed supercritical flow 10, having a Froude number greater than one.

The Froude number is a mathematical expression that describes the flow characteristics of water in terms of a velocity ratio, on one hand, or, an energy ratio, on the other. In terms of velocity, the Froude number is the ratio of the flow speed of a stream having a certain depth divided by the speed of the longest possible wave that can exist in that depth of water without breaking, i.e., the Froude number equals the flow speed divided by the square root of the acceleration of gravity times the depth of the water. In terms of energy, the Froude number is the ratio between the kinetic energy of the water flow and its potential (gravitational) energy, i.e., the Froude number squared equals the flow speed squared divided by gravity times water depth.

The Froude number can be used to describe differing hydraulic states of a moving body of water, such as those that occur in the present invention. For instance, it is useful in describing the difference between water flows that are moving at "supercritical," "critical," and/or "subcritical" speeds, as well as describing a "hydraulic jump."

A "supercritical" flow, for instance, which is a thin, fast-moving sheet flow of water, has a Froude number of greater than one, i.e., in terms of velocity, the speed of water flow is greater than the speed of the longest possible wave that can exist on that flow, and, in terms of energy, the kinetic energy of the water flow is greater than its gravitational potential energy. A "critical" flow, on the other hand, which is evidenced by breaking wave formations, has a Froude number equal to one, i.e., in terms of velocity, the speed of flow is equal to the speed of the longest possible wave that can exist on that flow, and, in terms of energy, the kinetic energy of the water flow is equal to its gravitational potential energy. And, a "subcritical" flow, which is generally a slow moving, thick flow of water, has a Froude number of less than one, i.e., in terms of velocity, the speed of flow is less than the speed of the longest possible wave that can exist on that flow, and, in terms of energy, the kinetic energy of the water flow is less than its gravitational potential energy.

The Froude number helps explain why a "supercritical" flow forms a thin, fast-moving sheet flow of water, with no stationary wave shapes thereon. That is, in terms of velocity, when the Froude number is greater than one, as discussed above, the speed of flow exceeds the speed of the longest possible wave that can exist on the flow at a given depth. In such conditions, any wave that might otherwise exist, or break, is quickly swept away by the water flow. Accordingly, no wave is formed, and the supercritical flow remains relatively constant and shallow in depth, so long as the Froude number exceeds one.

The Froude number also helps explain why a "subcritical" flow is relatively slow-moving and thick. As stated above, a "subcritical" flow occurs when the Froude number is less than one, i.e., in terms of velocity, this is when the speed of flow is less than the speed of the longest possible wave that can exist on the flow without breaking. That is, when the speed of flow is below the speed at which the longest possible wave can exist without breaking, the water flow builds up, and begins to thicken, forming a slow-moving, thick body of water.

A "critical" flow, on the other hand, is a relatively narrow transitional hydraulic state that occurs between the "supercritical" and "subcritical" states. As demonstrated by the Froude number, a critical flow occurs when, in terms of velocity, the speed of flow is equal to the speed of the longest possible wave that can exist on the flow at a given depth, and, in terms of energy, the kinetic energy of the water flow is equal to its gravitational potential energy.

This transition point, between the supercritical and subcritical hydraulic states, creates what is commonly referred to as a "hydraulic jump." A hydraulic jump typically occurs when there is an abrupt change in hydraulic state. From a velocity standpoint, the hydraulic jump is the wave-breaking point of the fastest wave that can exist at a given depth of water. From an energy standpoint, the hydraulic jump is the actual break point of the wave, which occurs at a point where the energy of the flow abruptly changes from kinetic to potential.

Any wave that might appear upstream of the hydraulic jump, for instance, in the supercritical flow, is unable to keep up with the flow, as discussed above, and consequently, no wave can exist. When the flow speed is reduced, however, i.e., through friction, the water flow builds up and ultimately breaks, wherein a hydraulic jump, or stationary wave, is created.

Because the hydraulic jump occurs only at the transition point between hydraulic states, it is relatively unstable and difficult to maintain in a moving body of water. That is, the stability of the hydraulic jump depends to a large extent on the relative speed and/or energy and depth of the adjacent "supercritical" and "subcritical" flows. Nevertheless, whenever the kinetic energy of the supercritical sheet flow dissipates, and/or the velocity reduces, and eventually becomes subcritical, a hydraulic jump occurs at the transition point, particularly when there is an abrupt change in hydraulic state, although the size, location and consistency of the hydraulic jump will vary, depending on the relative speed, energy and depth of the respective flows.

Returning to FIG. 4, to minimize the energy required to achieve mixed supercritical flow 10, it is preferred that the amount of water flowing over the grate (as evidenced by the thickness of the flow 22 above the jet nozzles 37), be as thin as possible, while permitting riders to maneuver over the grate, thus enabling the water flowing over the grate to become easily entrained with the supercritical flow 16. Too much water could result in an undesireable reduction in speed, and increase in depth, of the mixed supercritical flow 10, which could adversely affect its flow characteristics, from a Froude number standpoint.

The distance the mixed supercritical flow 10 remains supercritical in the direction of travel in the channel is partly a function of friction losses from the channel walls and floor. In a channel having a substantially constant elevation, these friction losses express themselves via a reduction in flow thickness until such point that the relationship between the flow depth and speed, as expressed by the Froude number, is equal to one, and therefore, a hydraulic jump occurs. In addition, a hydraulic jump cart be induced by an abrupt change in the depth of the channel, as shown by dashed line 63 in FIG. 4. In such case, as the depth increases, the velocity of the water undergoes a significant reduction, and the flow, as expressed by the Froude number, changes from greater than one, to less than one, and, therefore, a hydraulic jump occurs.

For additional water effects, additional jet nozzles can be provided as boosters along the shallow channel portion 15. For instance, at about half the length of the shallow floor, additional jet nozzles 57 can be provided, which are similarly hooked up to the upstream sump 45 system, so that an additional sheet flow of water 59 can be injected and propelled onto the shallow portion at that point, as shown in FIG. 2. This will help, for instance, the flow of water around a long turn 27, so that the length of the shallow channel portion can be extended, or otherwise provide a hydraulic boost along any portion of the shallow floor.

Additional jet nozzles (not shown) can also be provided at any other point on the shallow channel portion 15, such as along the outside edge 27 of a turn, to help the sheet flow of water around the turn. Individual jet nozzles, pointed in different directions, can also be provided intermittently along the shallow floor to provide special water effects which can cause a rider to suddenly change direction as a particular nozzle is encountered. These jet nozzles can be made to pivot and mechanically rotate so that they can continually change the direction of flow, making it virtually impossible for the rider to anticipate which direction he/she will be propelled at any given time. This can create a bumper boat effect which can cause, in some instances, riders to carom off one another, for additional effects.

In the preferred embodiment, between the shallow and deep channel portions there is a step up 61, or step down 63, as the case may be, from one depth to another, as shown in dashed lines in FIG. 4. The steps 61, 63 can be gradual, but are preferably steep, particularly on the downstream end 40 of the shallow channel portion. This is so that there is a noticeable differential in the depth of flow, which, in combination with a high volume of water in the channel, helps create a larger and more consistent hydraulic jump 55 at the point where the mixed supercritical sheet flow 10 meets the subcritical flow 18 in the deep channel portion. The downstream edge 40 of the shallow floor 11, and the step down 63, can also be angled or curved to create a hydraulic jump that extends along that angle or curve.

In an alternate embodiment, as partially shown in FIG. 4, there is no specific deep portion, and the entire channel floor is substantially shallow. The floor is also preferably substantially uniform in elevation, although topographical changes can be provided, as in the preferred embodiment, to create special flow effects.

In this embodiment, as in the preferred embodiment, water is drawn from a point 22 upstream of the jet nozzles 37, and propelled onto the channel floor through jet nozzles 37 to create a supercritical sheet flow 16. The floor 11 immediately downstream 43 from the jet nozzles 37 can be substantially horizontal, or can be slightly inclined. The elevation of the floor 39 of the channel upstream can be slightly higher, as shown in FIG. 4. This permits the jet nozzles 37 to be positioned substantially horizontally in relation to the floor 11, so that a substantially horizontal sheet flow of water can be formed thereon.

In this embodiment, the extent to which the mixed supercritical sheet flow of water 10 will remain supercritical is a function of not only friction losses, but also, in a closed system, relative differences in flow depth, between the supercritical and subcritical flows, created by the unidirectional flowing sheet flow 10. Because the floor of the channel in this embodiment is substantially uniform in elevation, there are no depth changes on the channel floor to create variations in flow depth, as in the preferred embodiment. Instead, flow depth differentials are created by the supercritical flow of water being injected unidirectionally onto the channel floor. That is, as the supercritical sheet flow of water forms a relatively thin, low volume, shallow flow area 20, immediately downstream from the jet nozzles 37, the water which would otherwise have been in that part of the channel is pushed downstream, wherein the sheet flow eventually slows down, builds up, and thickens, i.e., becomes subcritical, forming a relatively high volume, deep flow area 54, downstream. In a closed system containing a substantially constant volume of water, the reduction in volume in one area resulting from the supercritical sheet flow 10, necessarily results in a reciprocal increase in volume in another area, wherein the flowing body of water is placed in a substantially unstable state where the depth of the subcritical flow of water 18 is greater than the depth of the supercritical sheet flow 10.

The mixed supercritical sheet flow 10, which typically has a depth of between 3 to 6 inches, eventually forms a relatively low hydraulic pressure area 53, i.e., an area that is shallow due to the relatively low elevation of the water surface 20, as shown in FIG. 4. The subcritical flow of water 18, on the other hand, which typically has a depth of about 12 to 18 inches, eventually builds up and forms a relatively high pressure area 51, 54, i.e., an area that is deeper due to the relatively high elevation of the water surface 24, as shown in FIG. 4. The difference in depth forms a hydraulic pressure differential between the two flows.

As in the preferred embodiment, a hydraulic jump 55 is created at the transition point between the supercritical and subcritical flows. The quality and size of the hydraulic jump, however, in a closed system, is not only affected by the speed and depth of flow, which are relevant to the Froude number, but also hydraulic pressure differentials, discussed above, caused by the supercritical sheet flow. That is, as the hydraulic pressure differential increases, the tendency for there to be a more abrupt change in hydraulic state is increased.

For instance, when the water is stationary and there is no supercritical flow, the water surface in the channel will be substantially uniform in elevation, and no hydraulic differential will be present. As the supercritical sheet flow pushes water in the channel downstream, however, causing the sheet flow to become relatively shallow, and the subcritical flow to become relatively deep, the pressure differential between the supercritical and subcritical flows increases. As this occurs, the water in the high pressure area 51, 54 begins to seek the low pressure area 53, which can either be with or against the direction of flow, depending on the relative locations of the pressure areas. When the high pressure area 54 is downstream from the low pressure area 53, for instance, as the hydraulic jump is being formed, the subcritical flow 18 may actually spill backwards onto the advancing sheet flow, due to water seeking its own level, resulting in the formation of a more dramatic hydraulic jump 55. In fact, as a general rule, the greater the pressure differential between the mixed supercritical flow 10 and the subcritical flow 18, the greater will be the hydraulic jump 55 created.

Greater hydraulic pressure differentials will also occur with greater impact when the volume of water in the channel, in relation to the size of the channel, is relatively high, such as when the depth of the body of water in the channel, when stationary, is about 12 inches or more. Of course, with a higher volume of water in the channel, the supercritical sheet flow must have enough power and momentum to push the flow of water downstream. This is important in being able to form a supercritical sheet flow of water and to drive the unidirectional flowing body of water in the direction of flow around the channel loop.

When there is a relatively low volume of water in the channel, on the other hand, such as when the depth of the body of water is below 6 inches, the supercritical sheet flow does not have to have as much power and momentum to remain substantially supercritical for a relatively long period of time. In addition, there is less of a tendency for a significant hydraulic pressure differential to form between the supercritical and subcritical flows because there is less opportunity for the flows to have different flow depths. Accordingly, friction losses, more so than a change in hydraulic pressure, will tend to reduce the speed of flow, causing the energy of the supercritical sheet flow to dissipate more slowly, and the flow to eventually become critical, and then subcritical. While a dramatic hydraulic jump will not be created under these circumstances, there will nevertheless be a slight hydraulic jump at the transition point. Other water effects can also be created in the same manner as the preferred embodiment, such as by additional jet nozzles.

The grate 47 in this embodiment, as shown in FIG. 4, extends along the channel floor and is substantially uniform in elevation. Riders floating in the flowing body of water can easily flow over the grate 47 and towards the jet nozzles 37. The sump area 45 and pump 25 are positioned below the grate and beneath the level of the channel.

Figure 5A:
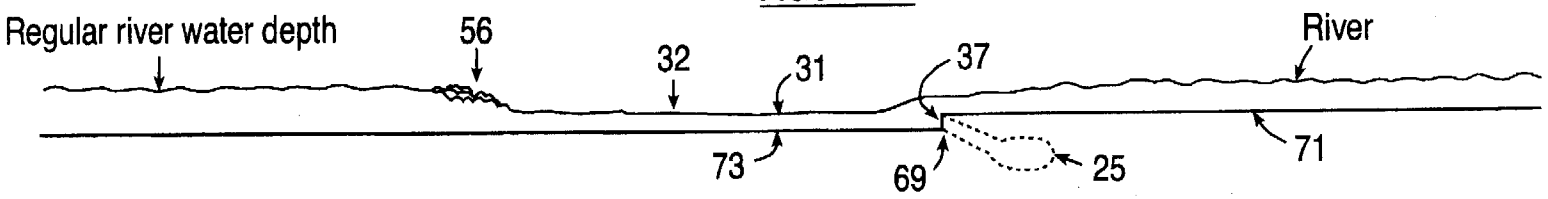
FIG. 5A is a cutaway view along A:A in FIG. 5.
Figure 5:
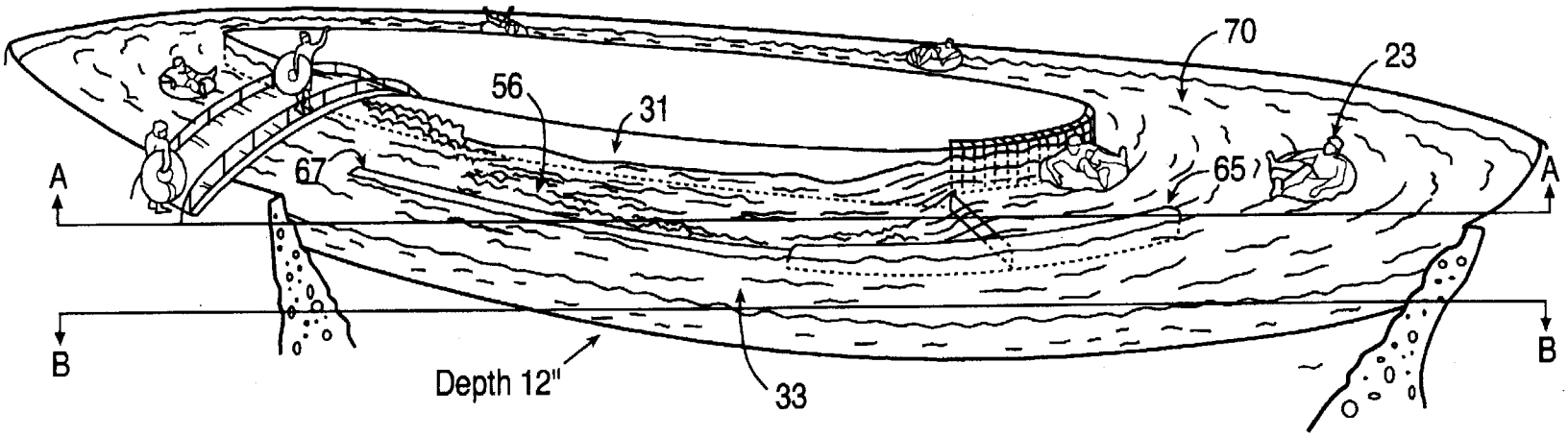
FIG. 5 is a perspective view of an alternate embodiment wherein the shallow channel portion extends along only one side of the channel.

In another embodiment, as shown in FIG. 5, a shallow flow area 31 extends along one side of the channel, so that part of the width of the channel is shallow, and part of the width is deep 33. The shallow flow area 31 preferably has a shallow flow 32 of about 3 to 6 inches in depth, and the deep flow area 33 preferably has a deep flow 34 of about 12 inches deep, although these amounts can differ substantially if desired. The unidirectional flowing body of water 70 extends around the entire channel loop at about the same depth as the deep flow 34.

Figure 5B:
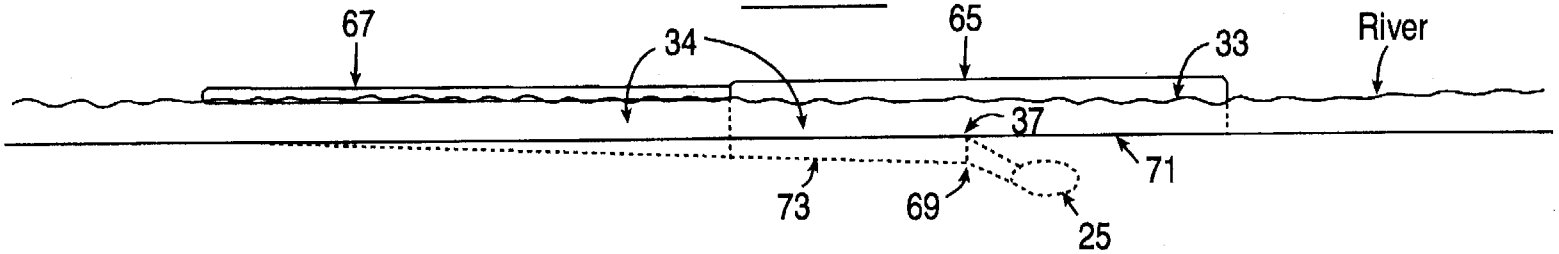
FIG. 5B is a cutaway view along B:B in FIG. 5.

The embodiment shown in FIGS. 5, 5*a* and 5*b* is much like the embodiment discussed above having a channel floor 71 with substantially uniform elevation. That is, the shallow flow 32 in the shallow flow area 31 is formed by the supercritical speed of the water propelled onto the channel floor 71, while the deep flow 34 in the deep flow area 33 is formed by the unidirectional flowing body of water otherwise flowing in the channel at subcritical speed. The hydraulic pressure differential between the two flows is created by the difference in the depth of flow, particularly at the point where the sheet flow is injected 69, and at the point where the sheet flow slows down to critical speed to create a hydraulic jump 56.

The shallow flow area 31 is separated longitudinally from the deep flow area 33 by a divider wall 65. The divider wall 65 extends upward from the floor of the channel and above the surface level of water in the channel and substantially separates the shallow flow area 31 adjacent the jet nozzles 37 from the deep flow area 33. A floating divider 67, however, extends downstream from the divider wall 65, to help keep riders in the downstream end of the shallow flow area 31 from crossing over into the deep flow area 33, while allowing water to flow underneath from the deep flow area 33 into the shallow flow area 31, so as to help form an extended hydraulic jump 56 along that side of the flow area. That is, a subcritical flow of water is permitted to flow into the path of the supercritical flow of water along that side, so as to create a tangentially crossing hydraulic jump 56.

This embodiment has a pump beneath the channel floor 71, as in the other alternate embodiment, and a grate 47 that prevents riders from being accidentally drawn into the pump 25 area. The shallow flow area 31 has a floor 73 that is slightly lower in elevation at the upstream end adjacent the jet nozzles 37 and gradually slopes upward as shown in dashed line in FIG. 5*b*. This is to permit water flowing from the jet nozzles to be injected substantially horizontally onto the shallow flow area 31, which helps to keep the shallow flow 32 horizontal and substantially thin.

In this embodiment, the riders 23 have the option of riding the supercritical sheet flow 32, or the slow moving water 34 in the deep portion, as he/she circles around. The shallow flow area 31 is preferably on the inside of the loop, as shown in FIG. 5, although the shallow flow area 31 can also be positioned on the outside of the loop.

In each of the embodiments, the center of the river loop can be an island 65 upon which other attractions, decking, sand and/or vegetation can be placed. A bridge 66 can extend across the channel to the island so that riders can cross over the channel. Stairs 67 can be located on the island as an entrance/exit into the deep channel portion. The entrance and exit area 68 is preferably on the inside of a turn 28 adjacent a relatively calm area in the water, i.e., a relatively deep portion, so that riders attempting to enter or exit the channel do not interfere with riders flowing around the channel.

Operation of the Present Invention

The present invention can be operated by simply turning on the pump 25 to begin the flow of water 16 in the direction of flow. In the preferred embodiment, the pump 25 begins to draw water from the deep channel portion 17, through the sump 45 area, and the jet nozzles 37, and injects it onto the shallow channel portion 15.

The pressure created by the pump 25 forcing water through the narrow openings 38 of the jet nozzles 37 creates a supercritical flow of water 16 on the shallow channel portion. In the preferred embodiment, the supercritical flow of water, as it exits into the deep channel portion, helps, through momentum transfer, drive the slow moving subcritical flow of water 18 in the deep channel portion, so that it drives the unidirectional flowing body of water 19 around the channel. In the alternate embodiments, the supercritical sheet flow of water flows substantially horizontally until the sheet flow slows down and thickens, forming a hydraulic jump, although the flow is sufficient to drive the unidirectional flowing body of water all the way around the channel loop.

A rider can ride on the unidirectional flowing body of water 19 on a floatation device, or inner tube 70. The rider can enter the water ride virtually anywhere along the side of the channel, but preferably enters in the appropriate location 68, which is down the stairs 67 located on the inside of a turn 28 adjacent the deep channel portion, as shown in FIG. 2. The rider can begin the ride by floating in the deep channel portion 17, whereby, the slow moving current will eventually carry the rider towards the shallow channel portion 15. Of course, the rider can paddle towards the shallow channel portion if desired, particularly in the embodiment where a portion of the channel has thereon a shallow flow 32, and a portion has thereon a deep flow 34.

The flow of water begins to speed up at or near the shallow channel portion 15. Even the water 22 upstream of the jet nozzles 37 begins to flow faster due to the pressure differential between the deep portion and the shallow portion discussed above, and the natural flow of water towards the sump 45 as water is drawn in. Once the rider is caught in the faster moving flow, the rider easily traverses over the grate 47 and sump area 45 and onto the shallow channel portion 15, where the rider is jetted by the supercritical sheet flow and accelerated. The depth of the sheet flow 10, 16 is preferably sufficient to cause the floatable device, or inner tube 70, to float on the water, so that there is little or no drag, which would tend to slow the velocity of the rider. Nevertheless, the momentum of the sheet flow is preferably strong enough that even if the floatable device, or inner tube 70, scrapes the shallow floor 11, the rider would accelerate through the shallow channel portion.

In various embodiments of the present invention, there can be installed additional jet nozzles that would cause additional special water effects on the shallow channel portion. For instance, the intermittent placement of jet nozzles pointed in continually changing directions will cause the rider to suddenly change directions upon encountering the nozzles. This may cause the rider, for instance, to zig-zag through the shallow floor, or to bump inner tubes with other riders, or to rotate around in the inner tube. Various topographical changes on the shallow floor will also cause the rider to experience unique water effects.

In an embodiment with an embanked turn, the rider can be carried around the outside of the turn, due to centrifugal forces acting on the rider. It is important to have side walls 7, 9 that contain the rider and the flow of water along the turn, as discussed above. In an embodiment that has a straight shallow channel portion, as shown in FIG. 3, the rider is likely to accelerate in a straight line, unless, of course, other jet nozzles, or topographical changes, are provided.

In the preferred embodiment, at the downstream end 40 of the shallow channel portion 15, the rider transitions into the deep channel portion 17, preferably through a hydraulic jump 55, as shown in FIGS. 1, 3 and 4. The hydraulic jump creates special water effects for the rider, such as bubbles, boils and shear flows, as well as ensures that the rider becomes sufficiently doused with water at that point. Once the rider enters the deep channel portion 17, the rider can continue to float and be carried onto the shallow channel portion again, or can exit the water ride. The rider has the option of being able to continually ride the water ride, over and over, or exit after a single loop. A rider riding the embodiment with a constant elevation floor also rides the water ride in a similar fashion.

In an embodiment where only a part of the width of the channel is provided with a shallow flow area 31, as shown in FIG. 5, the rider can choose to maneuver away from the supercritical flow, or can enter the supercritical flow, on his/her way around the channel. The hydraulic jump 56 in that embodiment extends along only a part of the width of the channel, so that the rider can avoid the hydraulic jump on any given loop if desired.

Embodiments having multiple numbers of shallow channel portions and deep channel portions can also be provided so that the length of the loop is extended. With an extended length, a variety of additional jet nozzles can be provided, to provide a variety of different water effects. Additional connected water rides, such as those disclosed in the previously mentioned related patents and applications, can also be provided.

The embodiments disclosed herein contain certain characteristics and elements that are considered to be part of the present invention. However, the disclosed embodiments, and their characteristics, are not intended to be exhaustive. Other embodiments, with other characteristics, which are not disclosed, are also intended to be within the scope of the following claims.

What is claimed is:

1. A water ride attraction for use in amusement parks, water theme parks, and the like, comprising:

an endless channel loop having a predominantly unidirectional flowing body of water therein, said channel loop having at least one substantially shallow portion, followed in the direction of flow, by at least one substantially deep portion;

a means for injecting a supercritical sheet flow of water directly onto said shallow portion in said direction of flow, wherein the sheet flow of water flows from said shallow portion and into said deep portion, and through momentum transfer, causes said unidirectional flowing body of water in said deep portion to flow in said direction of flow; and wherein a rider floating in said flowing body of water can ride on said sheet flow, and then be carried into said deep portion, and can then reenter said shallow portion from the deep portion, without having to exit said water ride.

2. The water ride of claim 1, wherein the shallow portion has a substantially horizontal floor, such that said sheet flow of water is injected onto said shallow portion substantially horizontally.

3. The water ride of claim 1, wherein the means for injecting a supercritical sheet flow has at least one nozzle that is positioned such that it injects said sheet flow of water from the floor of said channel substantially horizontally onto said shallow portion, wherein the sheet flow of water on said shallow portion is substantially between 3 to 6 inches in depth.

4. The water ride of claim 1, wherein the channel is adapted with at least one downward change in elevation which causes the flow of water flowing from the shallow portion and into the deep portion to slow down and change from supercritical to critical speed, creating a hydraulic jump at or near the change in elevation.

5. The water ride of claim 1, wherein the means for injecting a supercritical sheet flow is substantially positioned such that it injects the sheet flow of water into an area that is immediately upstream, in the direction of flow, of the shallow portion, such that the sheet flow of water is substantially unattenuated and flows at supercritical speed directly onto the shallow portion.

6. The water ride of claim 1, wherein the flow of water around the channel loop is generated predominantly by said means for injecting a supercritical sheet flow of water.

7. The water ride of claim 1, wherein the shallow portion of said channel loop is curved in the direction of flow, and has a slightly embanked floor such that said sheet flow of water travelling at supercritical speed on said shallow portion substantially conforms to the contours of said shallow portion.

8. The water ride of claim 1, wherein the channel has thereon topographical changes which alter the flow of water within the channel.

9. The water ride of claim 1, wherein jet nozzles that are capable of injecting water in various directions are intermittently positioned along the shallow portion such that water can be injected directly onto said shallow portion, and the direction of flow at predetermined points on the shallow portion can be altered.

10. The water ride of claim 1, wherein the surface of the body of water is said channel loop is substantially uniform in elevation but for the injection of water onto said shallow portion form said means for injecting a supercritical sheet flow of water.

11. A water ride attraction for use in amusement parks, water theme parks, and the like, comprising:

a channel having a channel floor and adapted to have therein a body of water flowing in a predetermined direction, wherein at least a porting of said body of water flowing in said channel is substantially shallow, and at least a portion of said body of water flowing in said channel is substantially deep; and at least one means for injecting a sheet flow of water directly onto the channel floor to drive said body of water in said predetermined direction, wherein the sheet flow of water flows onto said shallow portion, and then onto said deep portion, such that a rider can be carried by said sheet flow of water from said shallow portion, and into said deep portion.

12. The water ride of claim 11, wherein the water ride is adapted so that said sheet flow of water flowing directly onto said channel floor is substantially unattenuated and forms a supercritical sheet flow of water.

13. The water ride of claim 11, wherein the shallow portion is positioned longitudinally in the direction of flow along one side of the channel, and wherein another deep portion extends along another side of said channel wherein the shallow portion and another deep portion are separated by a dividing wall.

14. The water ride of claim 11, wherein the water ride is adapted so that the sheet flow of water in injected directly onto the shallow portion and extends substantially horizontally across the width of said shallow portion.

15. The water ride of claim 11, wherein the water ride is adapted so that the sheet flow of water flows at supercritical speed on said channel floor, and at the junction of said shallow portion and said deep portion, a hydraulic jump is created as the speed of flow is reduced from supercritical to critical.

16. The water ride of claim 11, wherein the sheet flow of water is injected directly into said shallow portion and the momentum of said sheet flow of water in said shallow portion helps to drive the water flowing in said deep portion of said channel in said predetermined direction by momentum transfer.

17. The water ride of claim 11, wherein the channel forms an endless loop, and the means for injecting a sheet flow of water is adapted so that it substantially drives the momentum of said flow of water around said loop, such that the rider can ride said water ride repeatedly without having to exit the water ride.

18. A water ride attraction for use in amusement parks, water theme parks, and the like, comprising:

a channel in the form of an endless loop having a substantially shallow floor and a unidirectionally flowing body of water therein; and at least one means for injecting a supercritical sheet flow of water onto said channel floor in a predetermined direction, wherein the means for injecting said sheet flow of water, through momentum transfer, increases the velocity of said flowing body of water in the direction of flow, such that a hydraulic pressure differential is created between the sheet flow of water and a downstream portion of the flowing body of water, and wherein a rider floating in said flowing body of water can be accelerated by said sheet flow, and can then be carried around said loop on said flowing body of water in the direction of flow.

19. The water ride of claim 18, wherein the water ride is adapted so that a hydraulic pressure differential is created by said supercritical sheet flow of water, and wherein a shallow low pressure area is created by said sheet flow of water in the direction of flow immediately downstream from where water is introduced into said channel, and a relatively deep high pressure area is created by said flowing body of water as said sheet flow of water accumulates, increases in depth and reduces in speed to become critical, and then subcritical in the direction of flow.

20. The water ride of claim 19, wherein the channel floor is adapted with a change in elevation to create a hydraulic jump at the transition point between, in the direction of flow, the supercritical sheet flow of water and the subcritical flow of water.

21. The water ride of claim 19, wherein the water ride is adapted so that the supercritical sheet flow of water can be injected substantially horizontally and with sufficient power to cause the sheet flow of water to flow downstream, thereby causing the depth of the relatively deep high pressure area to increase, as the depth of the water in the relatively shallow low pressure area reciprocally decreases.

22. The water ride of claim 18, wherein the water ride is adapted so that the supercritical sheet flow of water slows down due to friction to a critical speed, wherein a hydraulic jump is created, and wherein said flow then becomes subcritical.

23. The water ride of claim 18, wherein the water ride is adapted so that the supercritical sheet flow forms a relatively shallow flow of water, whereas the flowing body of water, which is at subcritical speed, forms a relatively deep flow of water, wherein a hydraulic jump is formed at the transition point between the supercritical and subcritical flows.

24. The water ride of claim 23, wherein the water ride is adapted so that a hydraulic pressure differential exists between said supercritical and subcritical flows, such that as the hydraulic pressure differential is increased, the tendency of the water in the subcritical flow to flow backwards against the direction of flow is increased, thereby causing a more dramatic hydraulic jump, as the supercritical sheet flow meets the subcritical flow of said flowing body of water.

25. The water ride of claim 18, wherein said means for injecting a sheet flow of water has at least one sump area that is positioned beneath the level of the channel, and at least one pump that draws water from the channel, and then, through at least one jet nozzle, injects the water onto the channel at supercritical speed.

26. The water ride of claim 25, wherein water being drawn by said pump helps to lower the elevation of the water substantially adjacent the sump area, and to form a pressure differential between an area upstream of the sump area, relative to the direction of flow, and an area downstream.

27. The water ride of claim 18, wherein the channel has a floor having a substantially uniform elevation.

28. The water ride of claim 18, wherein the channel has a floor having topographical changes thereon.

29. A water ride for use in amusement parks, water theme parks, and the like, comprising:

an endless channel loop having a channel floor and a unidirectional flowing body of water therein; and at least one means for pumping water from said flowing body of water, and propelling said water directly onto said channel floor in the direction of flow to form a sheet flow of water, wherein said sheet flow of water, through momentum transfer, causes said flowing body of water in said channel loop to flow around said channel loop.

30. The water ride of claim 29, wherein a shallow portion is provided having a substantially horizontal floor extending immediately downstream from where the sheet flow of water is introduced into said channel loop, and wherein an abrupt change in elevation is provided downstream from said shallow portion, forming a relatively deep portion, such that the sheet flow of water substantially accumulates, increases in depth and reduces in speed to a critical speed, and then to a subcritical speed, at or near said change in elevation.

31. The water ride of claim 29, wherein a portion of the channel floor immediately downstream from where the sheet flow of water is introduced into said channel loop is substantially shallow and horizontally oriented such that said sheet flow of water travels at supercritical speed and substantially unattenuated along said shallow floor portion.

32. The water ride of claim 29, wherein the channel floor has at least one downward change in elevation which substantially reduces, rather than increases, the speed at which said sheet flow of water travels through said channel, due to the accumulation and build up of water in said channel at or near the point of said downward change in elevation.

33. The water ride of claim 29, wherein the channel is adapted such that the sheet flow of water flows slightly upwardly onto said channel floor from below said channel floor.

34. The water ride of claim 29, wherein the channel and channel floor are adapted such that there are multiple shallow and deep portions positioned end to end within the channel loop.

35. The water ride of claim 29, wherein an additional flow generator is provided along the channel loop downstream from the point where water is introduced into the channel loop to inject additional water onto said channel floor.

36. The water ride of claim 29, wherein the means for pumping water is adapted such that it has at least one jet nozzle that injects water onto the channel floor from substantially below the floor of said channel, wherein the jet nozzle is oriented within the channel substantially normal to the direction of flow, such that the sheet flow of water flows substantially across the width of said channel floor.

37. The water ride of claim 29, wherein the channel is adapted to have at least one entrance into a relatively deep portion of said channel loop to enable riders to safely enter said flowing body of water.

38. The water ride of claim 29, wherein the endless channel loop is adapted such that there is an island positioned substantially in the middle of said loop, wherein a bridge is provided that connects said island to the area outside of said channel loop.

39. The water ride of claim 29, wherein said means for pumping water comprises at least one jet nozzle.

40. The water ride of claim 29, wherein the elevation of said body of water in said channel loop, but for the injection of water into said channel, is substantially uniform.

41. The water ride of claim 29, wherein the channel has two side walls to help maintain the body of water in said channel.

42. The water ride of claim 29, wherein the channel is coated with a sealant to seal said channel to prevent leakage.

43. The water ride of claim 29, wherein a suction in said channel is provided to remove water from said channel, said removed water being used to inject the sheet flow of water onto said channel floor.

44. The water ride of claim 29, wherein the surface of said floor is modified and configured to cause various water effects within said channel.

45. A method of providing a water ride for amusement parks, water theme parks, and the like, comprising:

providing an endless channel loop having a body of water therein;

pumping water into a flow generator and injecting a supercritical sheet flow of water;

directly onto the floor of said channel loop, such that said sheet flow of water is at the point of injection substantially unattenuated and flows substantially unidirectionally around said channel loop.

46. The method of claim 45, comprising injecting said sheet flow of water onto said channel floor to create a hydraulic pressure differential, wherein a shallow low pressure area is created by said sheet flow of water immediately downstream from the point where water is injected into the channel loop, and a relatively deep high pressure area is created further downstream from said shallow low pressure area.

47. The method of claim 46, comprising providing a predetermined amount of water in said channel loop, and pumping water from said body of water and injecting said flow of water such that the greater the speed of said sheet flow of water in the channel, the greater the hydraulic pressure differential that is created between the shallow low pressure area and the relatively deep high pressure area.

48. The method of claim 47, comprising increasing the speed of flow to increase the area of the shallow low pressure area formed on the channel floor, and reciprocally, decrease the area of the relatively deep high pressure area.

49. The method of claim 47, comprising decreasing the speed of flow to decrease the area of the shallow low pressure area formed on the channel floor, and reciprocally, increase the area of the relatively deep high pressure area.

50. The method of claim 47, comprising increasing the speed of flow to decrease the depth of the shallow low pressure area formed on the channel floor, and reciprocally, increase the depth of the relatively deep high pressure area.

51. The method of claim 47, comprising decreasing the speed of flow to increase the depth of the shallow low pressure area formed on the channel floor, and reciprocally, decrease the depth of the relatively deep high pressure area.

52. The method of claim 46, comprising increasing the hydraulic pressure differential between said shallow low pressure area and said deep high pressure area, by increasing the speed of flow, which increases the tendency of the water in the deep high pressure area to flow against the direction of flow, back onto the oncoming sheet flow of water in the shallow low pressure area, thereby creating a more dramatic hydraulic jump, as the sheet flow of water meets the slower, deeper body of water in said deep high pressure area.

53. The method of claim 45, comprising injecting said sheet flow of water at supercritical speed onto said channel floor and allowing it to continue to flow on said channel floor until it gradually slows down to friction, wherein the change in velocity causes a hydraulic jump to be formed at the point where the speed changes from supercritical to critical.

54. The method of claim 45, comprising injecting a flow of water at another point along the channel loop and affecting the sheet flow of water at said another point.

55. The method of claim 45, comprising providing variations in elevation along the channel floor, wherein the area immediately downstream from the point where water is injected into the channel loop is substantially shallow, allowing the sheet flow of water to travel at supercritical speed, and the area substantially downstream from said shallow area is substantially deep, such that when the sheet flow of water enters into said deep area from said shallow area, said sheet flow of water accumulates and reduces in speed from supercritical to critical to subcritical.

56. The method of claim 45, comprising dividing the channel loop, such that a portion of the body of water is injected at supercritical speed onto a substantially shallow portion, and a portion of the body of water flows around the substantially shallow portion and through a substantially deep portion positioned along the side of said shallow portion.

57. The method of claim 45, comprising injecting a portion of the body of water directly onto the channel floor, and allowing a portion of the body of water to flow over the area where water is injected onto the channel floor, wherein both portions of the body of water come together to form said sheet flow of water.

58. The method of claim 45, comprising injecting the sheet flow of water onto said channel floor substantially horizontally.

* * * * *